US009488091B2

(12) United States Patent
Kuramashi et al.

(10) Patent No.: US 9,488,091 B2
(45) Date of Patent: Nov. 8, 2016

(54) EXHAUST PIPE STRUCTURE WITH CATALYST FOR ENGINE

(71) Applicant: Mazda Motor Corporation, Aki-gun, Hiroshima (JP)

(72) Inventors: Taku Kuramashi, Hatsukaichi (JP); Ryota Joya, Aki-gun (JP); Tomonori Nishida, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 14/784,884

(22) PCT Filed: Apr. 9, 2014

(86) PCT No.: PCT/JP2014/002043

§ 371 (c)(1),
(2) Date: Oct. 15, 2015

(87) PCT Pub. No.: WO2014/171114

PCT Pub. Date: Oct. 23, 2014

(65) Prior Publication Data

US 2016/0076431 A1 Mar. 17, 2016

(30) Foreign Application Priority Data

Apr. 18, 2013 (JP) ..... 2013-087495

(51) Int. Cl.
*F01N 3/10* (2006.01)
*F01N 13/18* (2010.01)
(Continued)

(52) U.S. Cl.
CPC ..... *F01N 13/1844* (2013.01); *F01N 3/20* (2013.01); *F01N 3/2892* (2013.01);
(Continued)

(58) Field of Classification Search
CPC ..... F01N 3/2892; F01N 13/1872; F01N 13/1888; F01N 13/1844; F01N 13/10
USPC ..... 60/299, 323, 324
See application file for complete search history.

(56) References Cited

U.S. PATENT DOCUMENTS 6,082,103 A * 7/2000 Sugiura ..... F01N 13/008 60/272
6,840,039 B2 * 1/2005 Huh ..... B01F 3/02 60/323

(Continued)

FOREIGN PATENT DOCUMENTS

EP 1083307 A 3/2001
JP 2003-193829 A 7/2003
JP 2006-009793 A 1/2006

OTHER PUBLICATIONS

ISA Japanese Patent Office, Written Opinion of the International Searching Authority, Application No. PCT/JP2014/002043, Jul. 8, 2014, WIPO, 7 pages.

(Continued)

*Primary Examiner* — Jason Shanske
(74) *Attorney, Agent, or Firm* — Alleman Hall McCoy Russell & Tuttle LLP

(57) ABSTRACT

An exhaust pipe structure is the exhaust pipe structure with a catalyst converter provided immediately close to an engine and includes a plurality of exhaust passages and a collecting portion. The collecting portion arranged between the first exhaust passage provided at an end side and a second exhaust passage includes a first guiding portion, a second guiding portion, and a rotating/guiding portion. The exhaust gas introduced from the first exhaust passage and the exhaust gas introduced from the second exhaust passage are guided obliquely downward by the first guiding portion and the second guiding portion, respectively, and are then rotated and guided by the rotating/guiding portion in respective directions opposite to each other to flow toward the catalyst converter.

6 Claims, 18 Drawing Sheets

(51) Int. Cl.

| | |
|---|---|
| ***F01N 13/10*** | (2010.01) |
| ***F01N 3/28*** | (2006.01) |
| ***F01N 3/20*** | (2006.01) |
| ***F01N 13/08*** | (2010.01) |

(52) U.S. Cl.
CPC ..... *F01N 13/087* (2013.01); *F01N 13/10* (2013.01); *F01N 13/1872* (2013.01); *F01N 13/1888* (2013.01); *F01N 2240/20* (2013.01)

(56) References Cited

U.S. PATENT DOCUMENTS 7,578,124 B2 * 8/2009 Diez ..... F01N 3/2882 60/323
7,669,412 B2 * 3/2010 Ashida ..... F01N 13/10 60/313
2002/0069643 A1 * 6/2002 Yoshizawa ..... F01N 13/008 60/323
2003/0061807 A1 * 4/2003 Kim ..... F01N 3/28 60/323
2003/0121252 A1 * 7/2003 Huh ..... B01F 3/02 60/302
2003/0131594 A1 * 7/2003 Kawamizu ..... F01N 3/2892 60/299
2004/0020195 A1 * 2/2004 Ashida ..... F01N 13/1805 60/302
2004/0050039 A1 * 3/2004 Matsuda ..... F01N 3/046 60/323
2004/0226291 A1 * 11/2004 Diez ..... F01N 3/2882 60/323
2006/0005537 A1 * 1/2006 Park ..... F01N 13/18 60/323

OTHER PUBLICATIONS

ISA Japanese Patent Office, International Search Report Issued in Application No. PCT/JP2014/002043, Jul. 8, 2014, WIPO, 2 pages.

* cited by examiner

EXHAUST PIPE STRUCTURE WITH CATALYST FOR ENGINE

TECHNICAL FIELD

The present invention relates to an exhaust pipe structure with a catalyst converter provided in immediate proximity to an engine including a plurality of cylinders.

BACKGROUND ART

This type of exhaust pipe structure is disclosed in PTL 1, PTL 2, or the like.

PTL 1 discloses an exhaust manifold of a four cylinder engine. According to this exhaust manifold, a mixing chamber having an ellipsoidal shape is arranged next to exhaust ports lined up in a row, and a catalyst converter is continuously provided immediately under the mixing chamber. Four exhaust pipes extending from the respective exhaust ports are connected to an outer periphery of the mixing chamber.

PTL 2 discloses an exhaust pipe structure which diffuses the flow of exhaust gas flowing into a catalyst converter. According to this exhaust pipe structure, a collecting pipe (rotational flow generator) is provided between a collecting portion, where the exhaust pipes extending from the exhaust ports are collected, and the catalyst converter. The collecting pipe adjusts the flow of the exhaust gas from the exhaust pipes to convert the flow into rotational flow.

In each of PTLs 1 and 2, the catalyst converter is arranged at a middle portion in the cylinder row direction.

A pipe structure configured such that the catalyst converter is slightly offset from the middle portion in the cylinder row direction is also disclosed (PTL 3). The exhaust pipes are connected to a periphery of the ellipsoid-shaped collecting portion which is continuous with the catalyst converter, and the exhaust pipes are designed such that the exhaust gas flowing through each exhaust pipe flows toward the center of the collecting portion.

CITATION LIST

Patent Literature

PTL 1: Japanese Laid-Open Patent Application Publication No. 2003-193829

PTL 2: Japanese Laid-Open Patent Application Publication No. 2006-9793

PTL 3: European Patent No. 1083307 (EP1083307 B1)

SUMMARY OF INVENTION

Technical Problem

For convenience in design, the catalyst converter provided in immediate proximity to the engine has to be largely offset in the cylinder row direction from the middle portion in some cases.

In such cases, the flow of exhaust gas flowing from each exhaust pipe into the catalyst converter deviates. This tends to cause a decrease in the purification performance of the catalyst converter.

An object of the present invention is to provide an exhaust pipe structure which can introduce exhaust gas to a catalyst converter, provided in immediate proximity to an engine, in a balanced manner and has an excellent purification performance even in a case where the catalyst converter is largely offset.

Solution to Problem

An exhaust pipe structure of the present disclosure is an exhaust pipe structure with a catalyst converter provided in immediate proximity to an engine including three or more cylinders. The exhaust pipe structure includes: a plurality of exhaust passages which communicate with the respective cylinders, lined up along a cylinder row, and extend in a direction away from the engine; a collecting portion to which downstream end portions of the exhaust passages are collectively connected; and the catalyst converter connected to a lower side of the collecting portion.

The plurality of exhaust passages include: a first exhaust passage provided at an end side of the cylinder row; and a second exhaust passage adjacent to the first exhaust passage. The collecting portion is arranged between the first exhaust passage and the second exhaust passage in a cylinder row direction.

The collecting portion includes: a first guiding portion and a second guiding portion which are continuous with the first exhaust passage and the second exhaust passage, respectively, and extend so as to be spaced apart from each other and opposing each other, a downstream portion of the first guiding portion and a downstream portion of the second guiding portion being inclined obliquely downward; and a rotating/guiding portion which is continuous with a downstream side of the first guiding portion and a downstream side of the second guiding portion.

The collecting portion is configured such that: the exhaust gas introduced from the first exhaust passage and the exhaust gas introduced from second exhaust passage are guided obliquely downward by the first guiding portion and the second guiding portion, respectively; and the exhaust gas introduced from the first exhaust passage and the exhaust gas introduced from second exhaust passage are then rotated and guided by the rotating/guiding portion in respective directions opposite to each other to flow toward the catalyst converter.

To be specific, according to the exhaust pipe structure, the catalyst converter is connected to the lower side of the collecting portion arranged between the first exhaust passage, provided at the end side of the cylinder row, and the second exhaust passage adjacent to the first exhaust passage, and the catalyst converter is arranged so as to be largely offset.

In contrast, the exhaust gas introduced from the first exhaust passage and the exhaust gas introduced from the second exhaust passage are rotated and guided in respective opposite directions by the collecting portion to flow toward the catalyst converter. Therefore, a distance to the catalyst converter increases, and a flow velocity of the exhaust gas decreases while the exhaust gas is being diffused. As a result, when the exhaust gas flows into the catalyst of the catalyst converter, the uniformization of the distribution of the exhaust gas is accelerated. Thus, purification performance is improved.

Specifically, upper portions of the first and second guiding portions of the collecting portion bulge, and an exhaust gas sensor is arranged in a depression formed between the upper portions of the first and second guiding portions.

In this case, the exhaust gas sensor can be compactly arranged by utilizing the shape of the collecting portion.

More specifically, the exhaust pipe structure further includes an attachment flange which is attached to the engine and to which upstream end portions of the exhaust passages are connected. The attachment flange includes a plurality of fastening portions fastened to the engine. One of the fastening portions faces the depression formed between the upper portions of the first and second guiding portions.

In this case, adequate work spaces can be secured around the fastening portion facing the depression and on an extended line of the fastening portion. Therefore, the fastening can be easily performed, so that operability for the assembly of the attachment flange is excellent. In addition, since the fastening portion can be arranged near the exhaust passage, the attachment flange can be firmly attached to the engine.

More specifically, the plurality of exhaust passages and the collecting portion are formed in such a manner that a pair of upper and lower wall members face each other and are joined to each other.

In this case, even if the structures of the exhaust passages and the structure of the collecting portion are complex, the exhaust pipe structure can be easily produced. Therefore, the exhaust gas discharged from each cylinder can be appropriately guided to the catalyst converter. As a result, purification performance can be improved.

Advantageous Effects of Invention

According to the exhaust pipe structure of the present disclosure, even in a case where the catalyst converter is arranged so as to be largely offset, the exhaust gas can be introduced to the catalyst converter in a balanced manner, thereby achieving an excellent purification performance.

DESCRIPTION OF EMBODIMENTS

Figure 1:
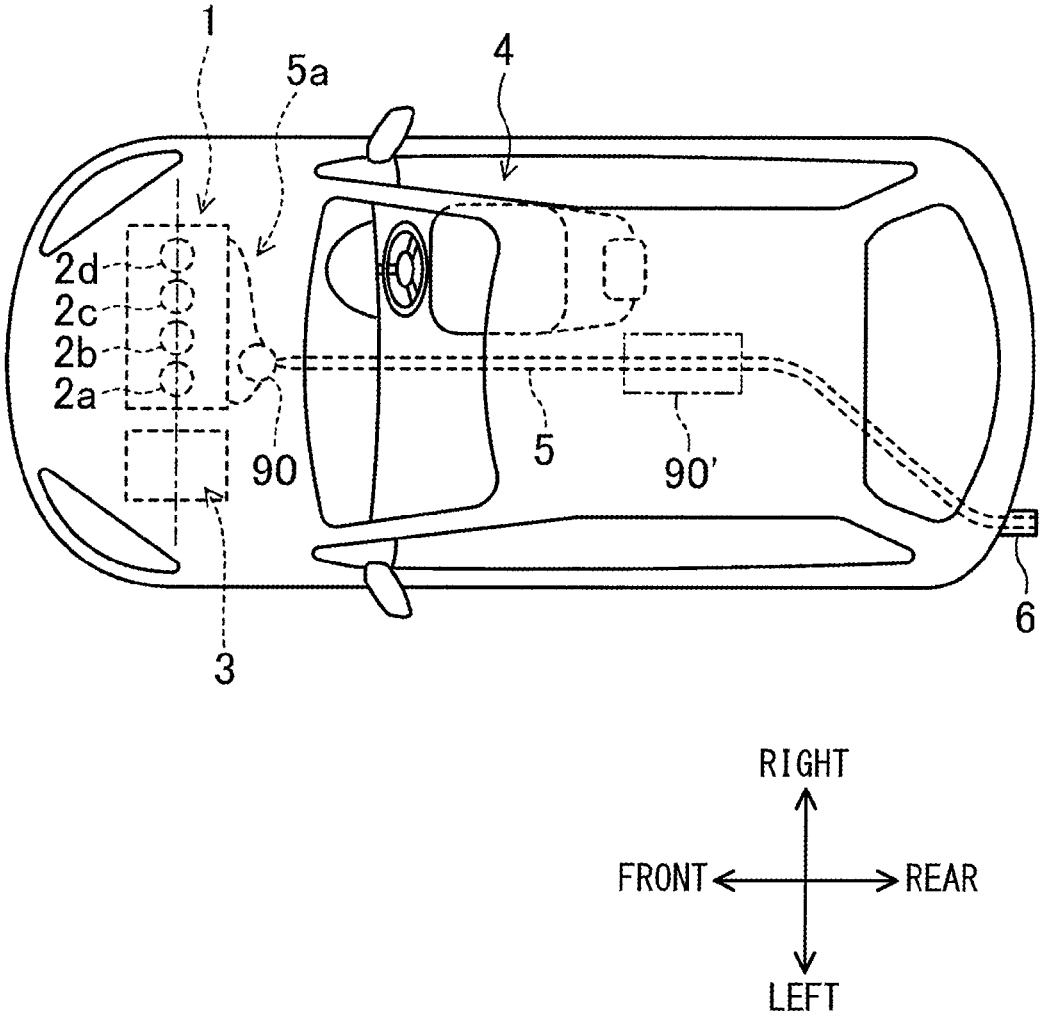
FIG. 1 is a schematic plan view showing one example of a car to which the present invention is applied.

Hereinafter, an embodiment of the present invention will be explained in detail in reference to the drawings. It should be noted that the following explanation is essentially just an example. The present invention, the things to which the present invention is applied, and use of the present invention are not limited. For convenience sake, directions such as front, rear, left, and right directions are based on directions indicated by arrows in the drawings unless otherwise mentioned.

FIG. 1 shows one example of a car to which the present invention is applied. This car is a front wheel drive type, and an engine 1 is mounted on a front side of the car. The engine 1 is transversely arranged such that a driving shaft extends in a car width direction.

The engine 1 of this car is an in-line four cylinder engine. Cylinders 2*a* to 2*d* are arranged so as to be lined up in series in the car width direction.

The engine 1 is arranged at a slightly right side in the car width direction, and a transmission 3 coupled to the driving shaft is arranged at a left side of the engine 1. A driver's seat 4 is arranged behind the engine 1.

An exhaust pipe 5 extends along a lower side of the car from a rear portion of the engine 1 toward a rear side. The exhaust gas flows through the exhaust pipe 5 and is discharged from a muffler 6 provided at a rear end of the car. To decompose and remove harmful components, such as hydrocarbons, contained in the exhaust gas, a catalyst converter 90 is disposed on a portion of the exhaust pipe 5.

In this car, the catalyst converter 90 is provided in immediate proximity to the rear portion of the engine 1. Depending on specifications, another catalyst converter 90' may be provided downstream of the catalyst converter 90 (In FIG. 1, the catalyst converter 90' is shown by a virtual line).

According to this car, to improve a driver protection performance with respect to a collision from a front side, the catalyst converter 90 is arranged so as to deviate, or be offset, toward a left portion of the engine 1 in the cylinder row direction (the cylinder row direction is a direction in which the cylinders 2*a* to 2*d* are lined up). In such a case, a distance from the cylinder 2*a* at the left end to the catalyst converter 90 to the catalyst converter 90 and a distance from the cylinder 2*d* at the right end to the catalyst converter 90 become largely different from each other. Therefore, a problem occurs, in which the flow of the exhaust gas flowing from the cylinder 2*a* to the catalyst converter 90, the flow of the exhaust gas flowing from the cylinder 2*b* to the catalyst converter 90, the flow of the exhaust gas flowing from the cylinder 2*c* to the catalyst converter 90, and the flow of the exhaust gas flowing from the cylinder 2*d* to the catalyst converter 90 differ from one another, thereby hindering efficient catalysis.

However, according to this car, even in a case where the catalyst converter 90 is largely offset relative to the engine 1, an exhaust pipe structure 5*a* provided in the vicinity of the engine 1 is devised such that the exhaust gas discharged from the cylinders 2*a* to 2*d* can be introduced to the catalyst converter 90 in a state where the exhaust gas is diffused substantially uniformly. Hereinafter, details will be explained.

Entire Configuration of Exhaust Pipe Structure

Figure 2:
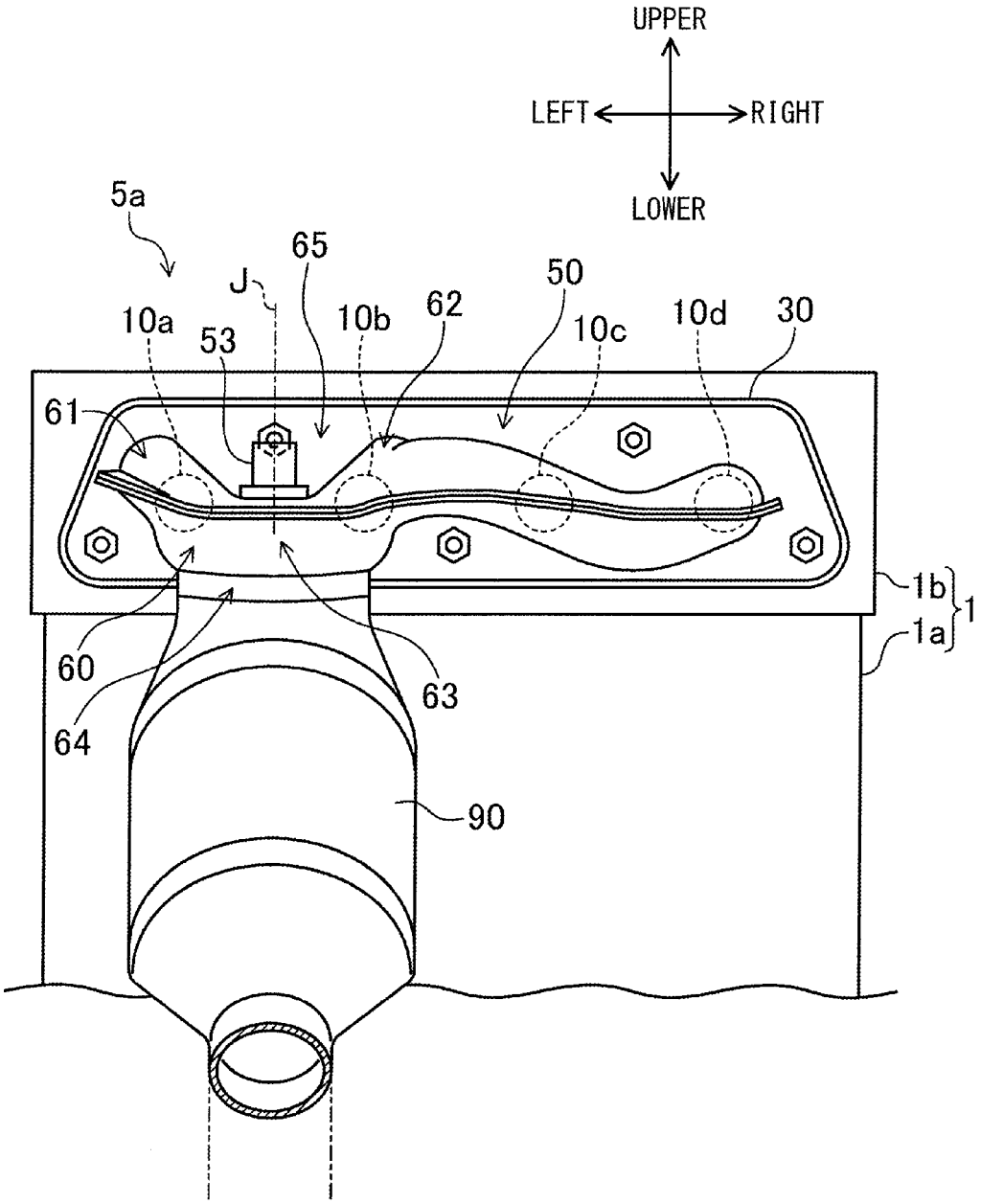
FIG. 2 is a schematic diagram of an exhaust pipe structure when viewed from behind.
Figure 3:
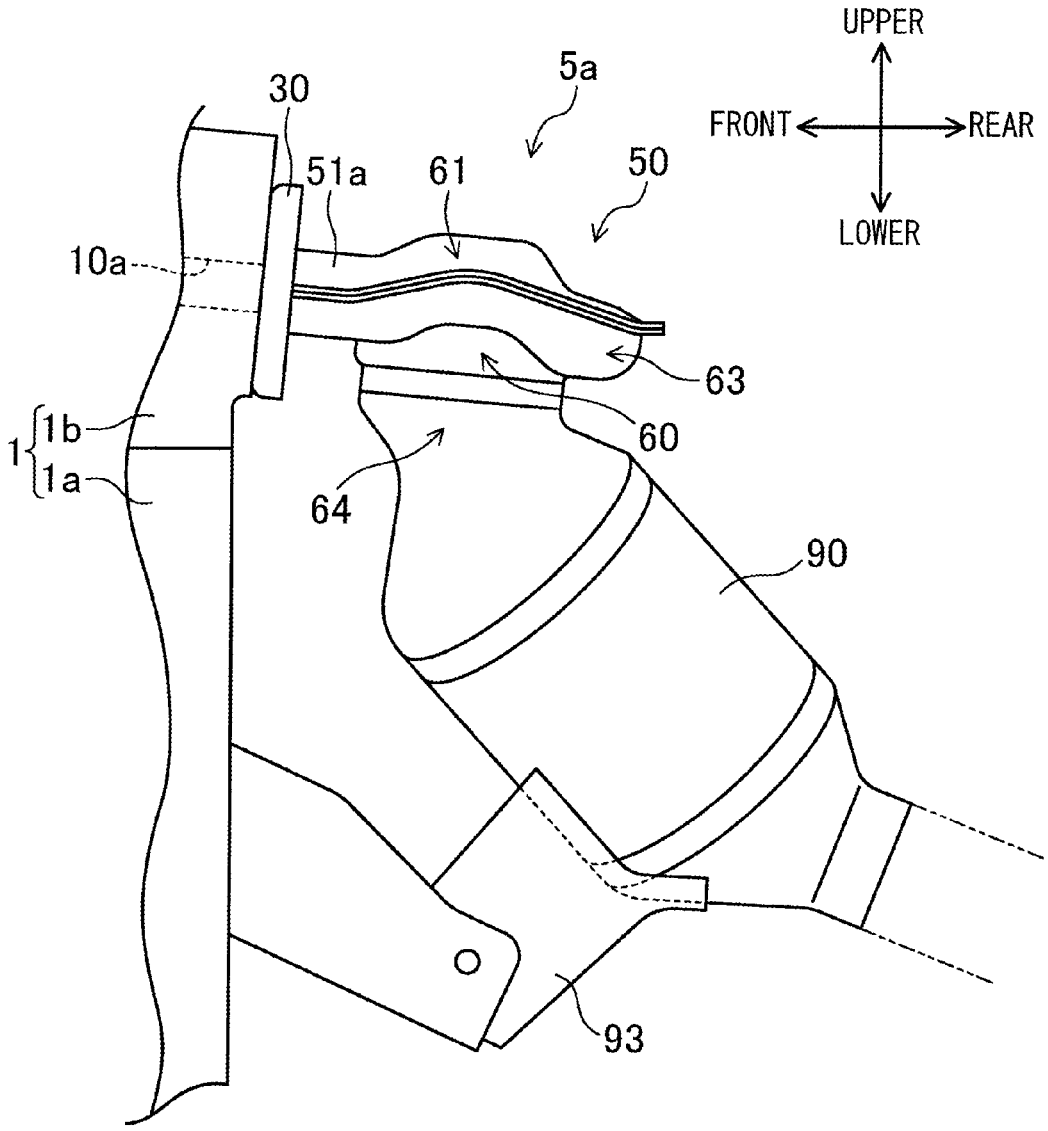
FIG. 3 is a schematic diagram of the exhaust pipe structure when viewed from a left side.
Figure 4:
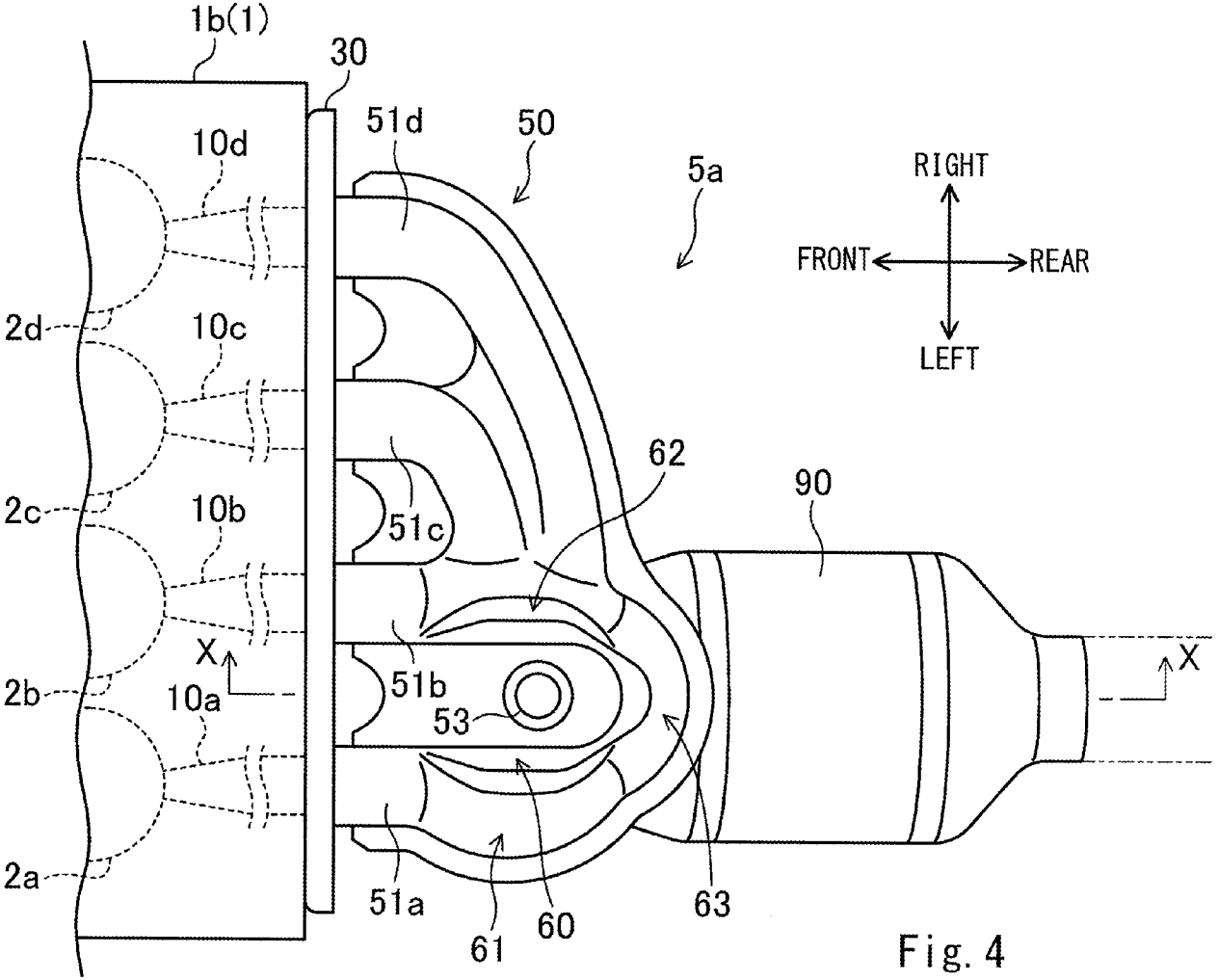
FIG. 4 is a schematic diagram of the exhaust pipe structure when viewed from above.

FIGS. 2 to 4 specifically show the exhaust pipe structure 5*a*. The exhaust pipe structure 5*a* is constituted by an attachment flange 30, an exhaust manifold 50, the catalyst converter 90, and the like. The exhaust pipe structure 5*a* is attached to a side portion of the engine 1, the side portion facing a rear side of the car.

The engine 1 includes a cylinder block 1*a* and a cylinder head 1*b* mounted on the cylinder block 1*a*. The attachment flange 30 is attached to a side surface of the cylinder head 1*b*. The catalyst converter 90 is attached to a bracket 93 provided at the cylinder block 1*a*. Thus, the exhaust pipe structure 5*a* is supported by the engine 1.

Respective ends of the first to fourth exhaust ports 10*a* to 10*d* transversely lined up are open on a side surface of the cylinder head 1*b*. The first to fourth exhaust ports 10*a* to 10*d* communicate with the cylinders 2*a* to 2*d*, respectively. The exhaust gas generated in the cylinders 2*a* to 2*d* is discharged through the first to fourth exhaust ports 10*a* to 10*d*. A cylinder row is constituted by the first cylinder 2*a*, the second cylinder 2*b*, the third cylinder 2*c*, and the fourth cylinder 2*d* lined up in this order from a left end. The first to fourth exhaust ports 10*a* to 10*d* correspond to the first to fourth cylinders 2*a* to 2*d*, respectively.

According to the first to fourth cylinders 2*a* to 2*d*, combustion is repeatedly performed in order of, for example, the fourth cylinder 2*d*, the second cylinder 2*b*, the first cylinder 2*a*, and the third cylinder 2*c*. Therefore, the exhaust gas is continuously discharged from the first to fourth exhaust ports 10*a* to 10*d* at different timings.

The exhaust manifold 50 has a function of collecting the exhaust gas discharged from the first to fourth exhaust ports 10*a* to 10*d* and discharging the exhaust gas to a downstream side. The exhaust manifold 50 includes first to fourth exhaust passages 51*a* to 51*d*, a collecting portion 60, and the like.

Upstream end portions of the first to fourth exhaust passages 51*a* to 51*d* are connected to the attachment flange 30, and the first to fourth exhaust passages 51*a* to 51*d* communicate with the first to fourth cylinders 2*a* to 2*d*, respectively. The first to fourth exhaust passages 51*a* to 51*d* are transversely lined up along the cylinder row at certain intervals and extend in a direction away from the engine 1. Downstream end portions of the exhaust passages 51*a* to 51*d* are collected and connected to the collecting portion 60 and communicate with one another.

According to the exhaust manifold 50, the collecting portion 60 is arranged between the first exhaust passage 51*a* and the second exhaust passage 51*b* in the cylinder row direction so as to be deviated. The first exhaust passage 51*a* and the second exhaust passage 51*b* are the same in length and relatively short. The first exhaust passage 51*a* and the second exhaust passage 51*b* extend in parallel with each other toward the rear side so as to oppose each other.

The third exhaust passage 51*c* is longer than each of the first exhaust passage 51*a* and the second exhaust passage 51*b*. The third exhaust passage 51*c* extends toward the rear side as with the first exhaust passage 51*a* and the second exhaust passage 51*b* and then curves and extends toward the collecting portion 60. The fourth exhaust passage 51*d* is longer than the third exhaust passage 51*c*. The fourth exhaust passage 51*d* extends a little toward the rear side, as with the third exhaust passage 51*c*, and then curves and extends toward the collecting portion 60.

The catalyst converter 90 is connected to a lower side of the collecting portion 60. The catalyst converter 90 is obliquely arranged such that a downstream side of the catalyst converter 90 inclines downward toward the rear side. A lower end portion of the catalyst converter 90 is supported by the bracket 93, the lower end portion being located away from the engine 1.

Figure 5:
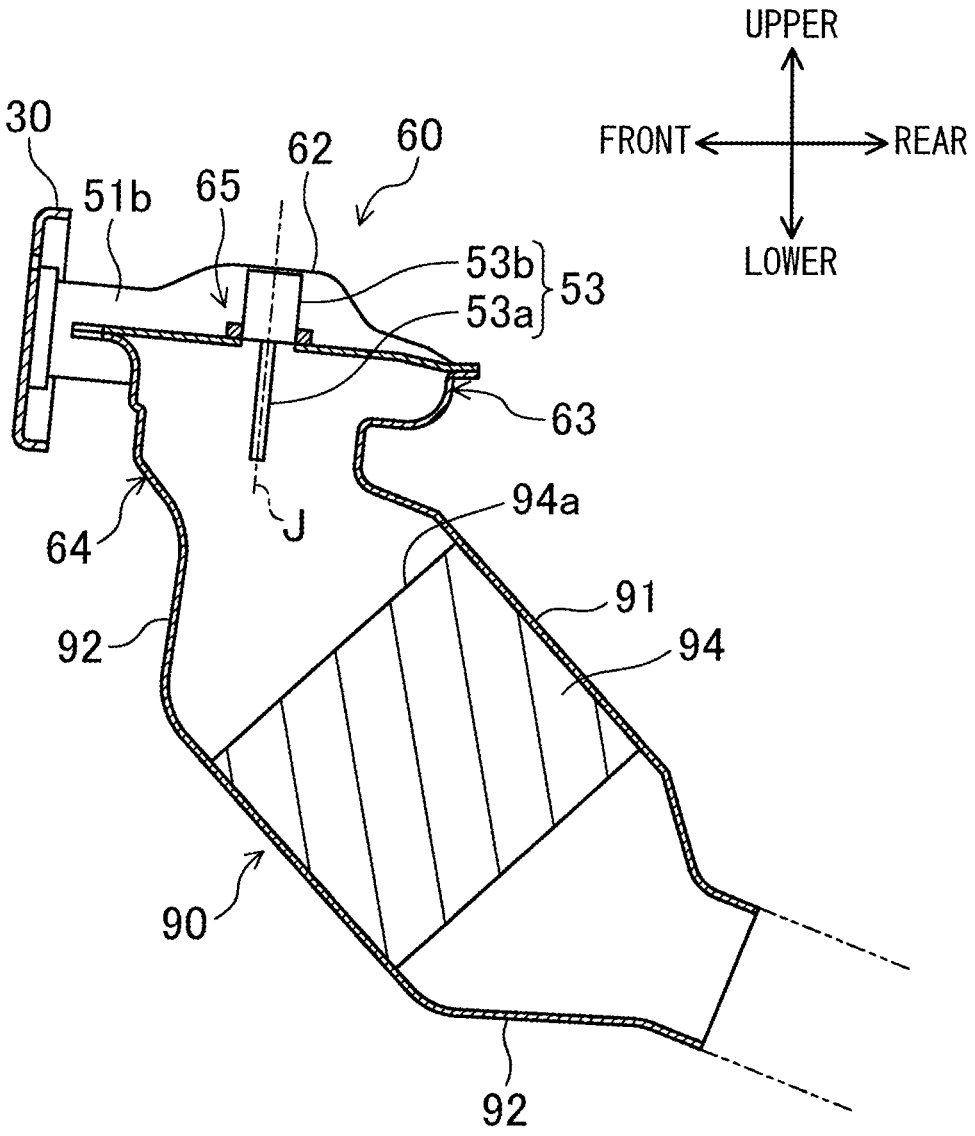
FIG. 5 is a schematic cross-sectional view taken along line X-X of FIG. 4.

As shown in FIG. 5, the catalyst converter 90 includes a cylindrical support case 91 and connection cases 92. The support case 91 extends along a gas channel. The connection cases 92 extend from both respective ends of the support case 91, and each of the connection cases 92 has a tapered shape. A catalyst 94 having a columnar shape is fitted in the support case 91. The exhaust gas discharged from the cylinders 2*a* to 2*d* flows into the catalyst 94 through a circular end surface 94*a* facing toward the upstream side.

Used as the catalyst 94 is a known three way catalyst. To cause the three way catalyst to efficiently exhibit a catalyst function, the three way catalyst needs to be maintained at a predetermined high temperature and combusted at around a theoretical air-fuel ratio. Further, it is also important to cause the exhaust gas to flow into the catalyst 94 while uniformly diffusing the exhaust gas over the entire circular end surface 94*a*.

An exhaust gas sensor 53 is provided at the exhaust manifold 50. The exhaust gas sensor 53 measures an oxygen concentration of the exhaust gas flowing out from the cylinders 2*a* to 2*d*. Respective combustion conditions of the cylinders 2*a* to 2*d* are adjusted and controlled based on a measured value of the exhaust gas sensor 53.

Figure 6:
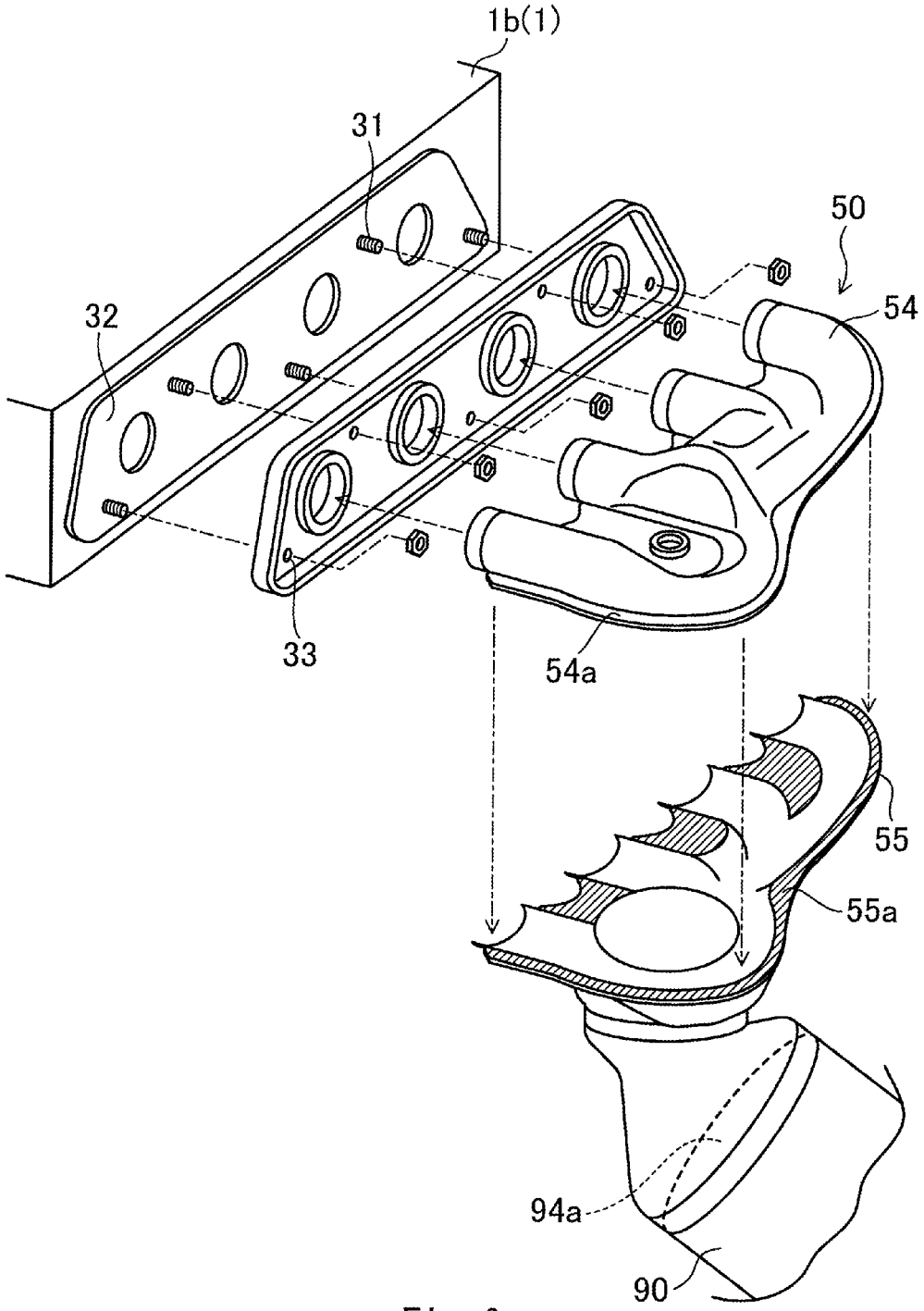
FIG. 6 is a schematic exploded perspective view of the exhaust pipe structure.

As shown in FIG. 6, the exhaust manifold 50 is formed in such a manner that a pair of upper and lower wall members 54 and 55 face each other and are joined to each other.

Specifically, each of the upper wall member 54 and the lower wall member 55 is a pressed product of a metal plate and is formed by pressing the metal plate, or in other words, cutting and shaping the metal plate into a predetermined shape. The upper wall member 54 constitutes substantially upper halves of the first to fourth exhaust passages 51*a* to 51*d* and a substantially upper half of the collecting portion 60. The lower wall member 55 constitutes substantially lower halves of the first to fourth exhaust passages 51*a* to 51*d* and a substantially lower half of the collecting portion 60.

Flange portions 54*a* and 55*a*, which are joined to each other, are formed at a peripheral edge of the upper wall member 54 and a peripheral edge of the lower wall member 55, respectively (the flange portions 54*a* and 55*a* are shown by diagonal lines in FIG. 6). These flange portions 54*a* and 55*a* are superimposed to each other and welded to each other, thereby integrally forming the first to fourth exhaust passages 51*a* to 51*d* and the collecting portion 60.

Thus, it is possible to easily produce the exhaust manifold 50 having a complex three-dimensional structure, which requires highly precise depressions and projections, and the exhaust gas of the cylinders 2*a* to 2*d* can be appropriately guided to the catalyst converter 90.

Partial Configuration of Exhaust Pipe Structure

Collecting Portion

The collecting portion 60 is provided with a first guiding portion 61, a second guiding portion 62, a rotating/guiding portion 63, a rotating portion 64, and the like (rotating structure). Each of the first guiding portion 61, the second guiding portion 62, and the rotating/guiding portion 63 has a function of rotating and guiding toward the catalyst converter 90 the exhaust gas flowing through the first exhaust passage 51*a* and the exhaust gas flowing through the second exhaust passage 51*b*.

The first guiding portion 61 constitutes an exhaust gas channel extending continuously from the first exhaust passage 51*a*. The first guiding portion 61 has a function of smoothly guiding the exhaust gas, introduced from the first exhaust passage 51*a*, through the rotating/guiding portion 63 and the rotating portion 64 to the catalyst converter 90. The second guiding portion 62 constitutes an exhaust gas channel extending continuously from the second exhaust passage 51*b*. The second guiding portion 62 has a function of smoothly guiding the exhaust gas, introduced from the second exhaust passage 51*b*, through the rotating/guiding portion 63 and the rotating portion 64 to the catalyst converter 90.

Figure 7:
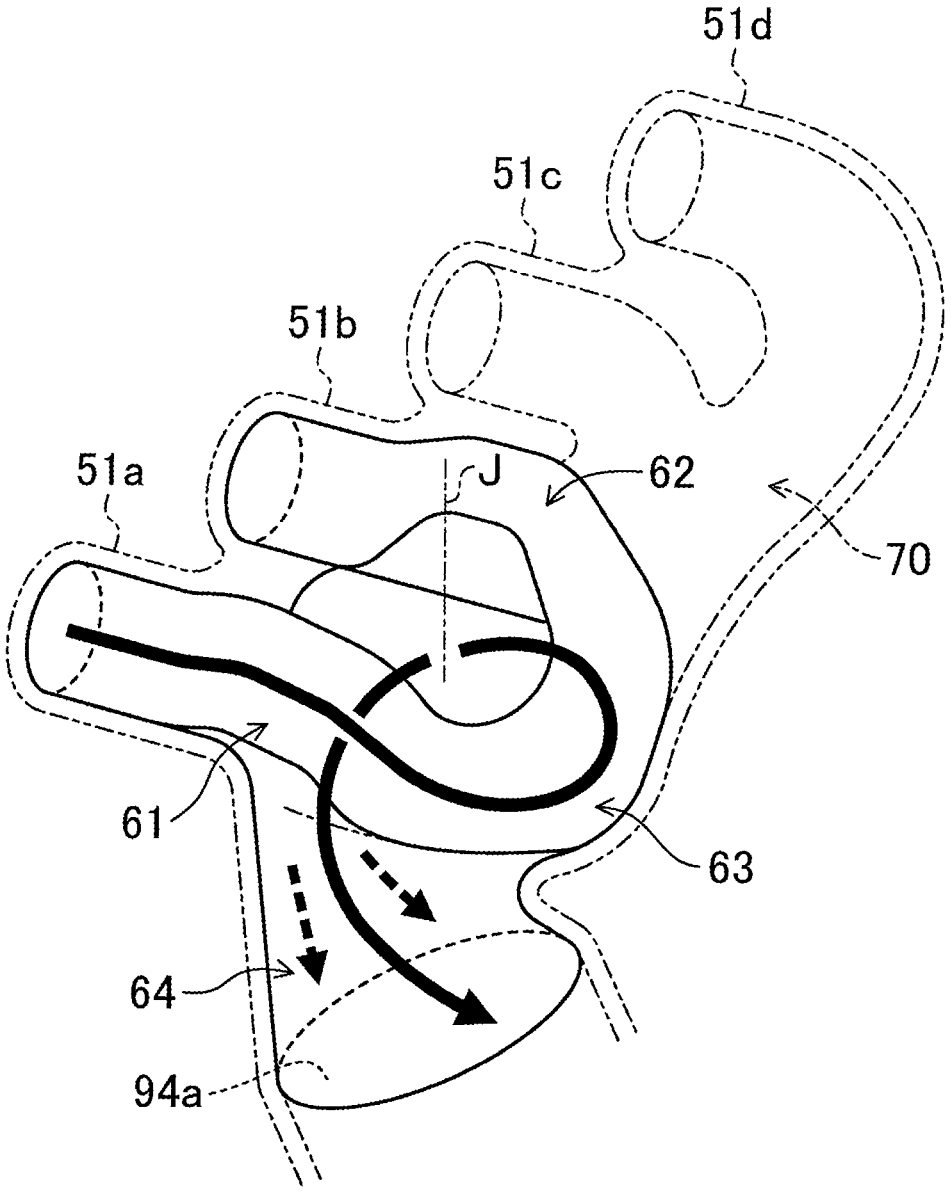
FIG. 7 is a schematic perspective view showing an internal space of an exhaust manifold, and a thick arrow denotes flow of the exhaust gas of a first cylinder.
Figure 8:
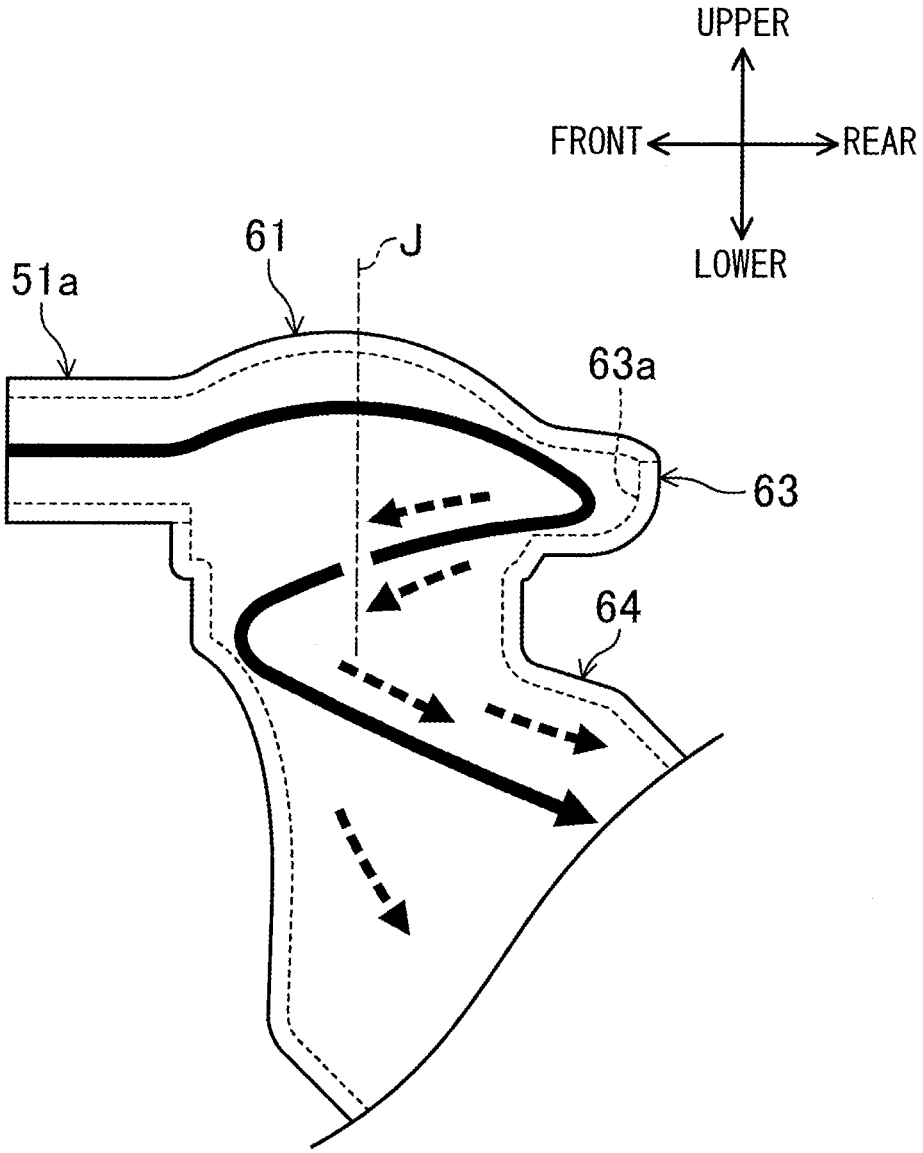
FIG. 8 is a schematic diagram of the internal space of the exhaust manifold when viewed from a lateral side, and a thick arrow denotes the flow of the exhaust gas of the first cylinder (second cylinder).
Figure 9:
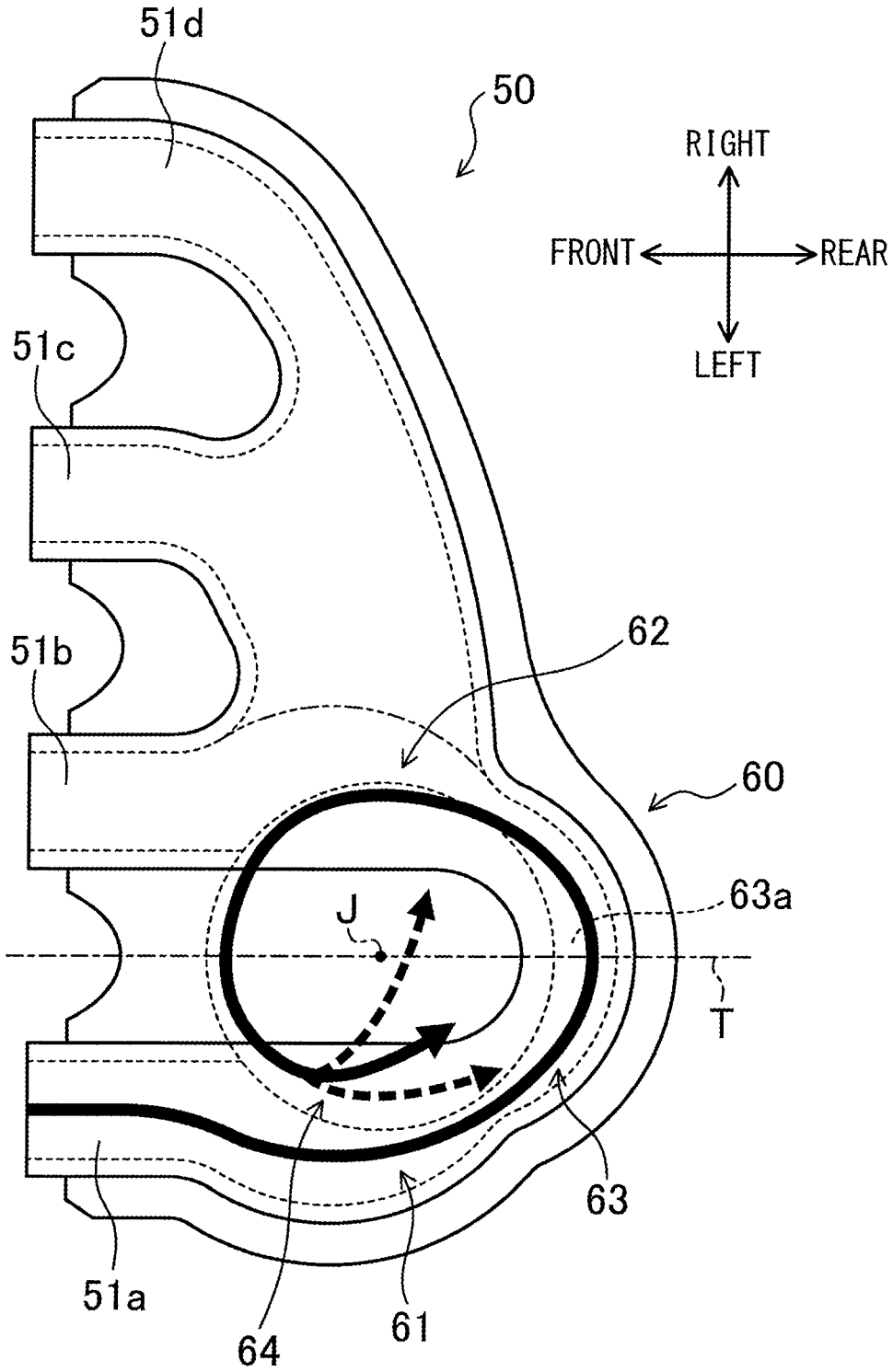
FIG. 9 is a schematic diagram of the internal space of the exhaust manifold when viewed from above, and a thick arrow denotes the flow of the exhaust gas of the first cylinder.

As shown in FIGS. 7, 8, and 9, the first guiding portion 61 and the second guiding portion 62 are spaced apart from each other, opposing each other, and extend in a direction away from the engine 1. An upstream portion of the first guiding portion 61 and an upstream portion of the second guiding portion 62 incline obliquely upward and curve so as to separate from each other. A downstream portion of the first guiding portion 61 and a downstream portion of the second guiding portion 62 incline obliquely downward and curve so as to approximate each other.

Therefore, the exhaust gas discharged from the first cylinder 2*a* and the exhaust gas discharged from the second cylinder 2*b* flow through the first guiding portion 61 and the second guiding portion 62, respectively, to curve and be guided obliquely downward.

Regarding the collecting portion 60, since the first guiding portion 61 and the second guiding portion 62 are provided such that an upper portion of the first guiding portion 61 and an upper portion of the second guiding portion 62 bulge, a depression 65 is formed between the first guiding portion 61 and the second guiding portion 62. The exhaust gas sensor 53 is compactly arranged by utilizing the depression 65.

As shown in FIG. 5, the exhaust gas sensor 53 includes: a rod-shaped sensor measuring portion 53*a* which measures the oxygen gas concentration; and a sensor main body portion 53*b* integrated with the sensor measuring portion 53*a*. The sensor measuring portion 53*a* extends in an upward/downward direction at a middle portion of the collecting portion 60 and projects to an inside of the rotating portion 64. The sensor main body portion 53*b* projects to an upper side of the collecting portion 60. The sensor main body portion 53*b* is accommodated in the depression 65 so as to be hidden between the first guiding portion 61 and the second guiding portion 62. Therefore, a wire and the like can be prevented from being caught by the sensor main body portion 53*b*.

The rotating portion 64 is a cylindrical space which communicates with the catalyst converter 90. The rotating portion 64 is constituted by a lower portion of the collecting portion 60 and is located under the first guiding portion 61 and the second guiding portion 62. The sensor measuring portion 53*a* extends along a vertical axis J extending through a center of the rotating portion 64, and a tip end of the sensor measuring portion 53*a* is located at a substantially middle position of the rotating portion 64.

The rotating/guiding portion 63 is an auxiliary space for the rotating portion 64, the auxiliary space projecting outward from an upper portion of the rotating portion 64. The rotating/guiding portion 63 is provided at a side of the rotating portion 64, the side being away from the engine 1. The rotating/guiding portion 63 is continuous with a downstream portion of the first guiding portion 61 and a downstream portion of the second guiding portion 62. The rotating/guiding portion 63 has a function of smoothly rotating and guiding the exhaust gas discharged from the first cylinder 2*a* and the second cylinder 2*b*.

Specifically, an inner surface of the rotating/guiding portion 63 includes a circular-arc curved surface (rotating/guiding surface 63*a*) which bulges from an inner surface of the rotating portion 64 and further rotates and guides the exhaust gas guided downward by the first guiding portion 61 and the second guiding portion 62. The rotating/guiding surface 63*a* is smoothly continuous with an inner surface of the downstream portion of the first guiding portion 61 and an inner surface of the downstream portion of the second guiding portion 62 and is also smoothly continuous with the inner surface of the rotating portion 64.

Accordingly, the exhaust gas flowing from the first guiding portion 61 to the rotating/guiding portion 63 and the exhaust gas flowing from the second guiding portion 62 to the rotating/guiding portion 63 are rotated and guided by the rotating/guiding portion 63 in respective directions, which are directions along a substantially horizontal direction opposing each other, to flow into the rotating portion 64 while being rotated.

Figure 10:
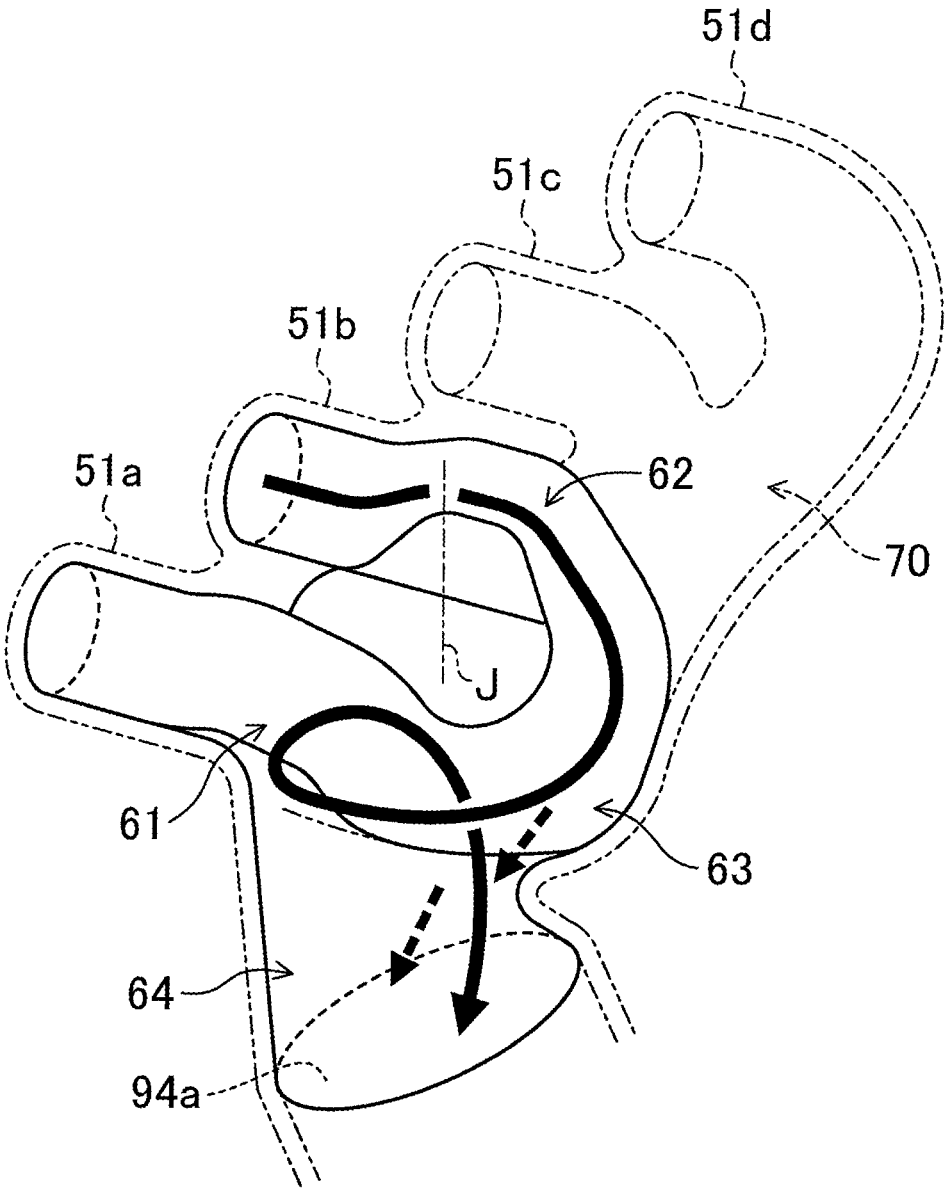
FIG. 10 is a schematic perspective view of the internal space of the exhaust manifold, and a thick arrow denotes the flow of the exhaust gas of the second cylinder.
Figure 11:
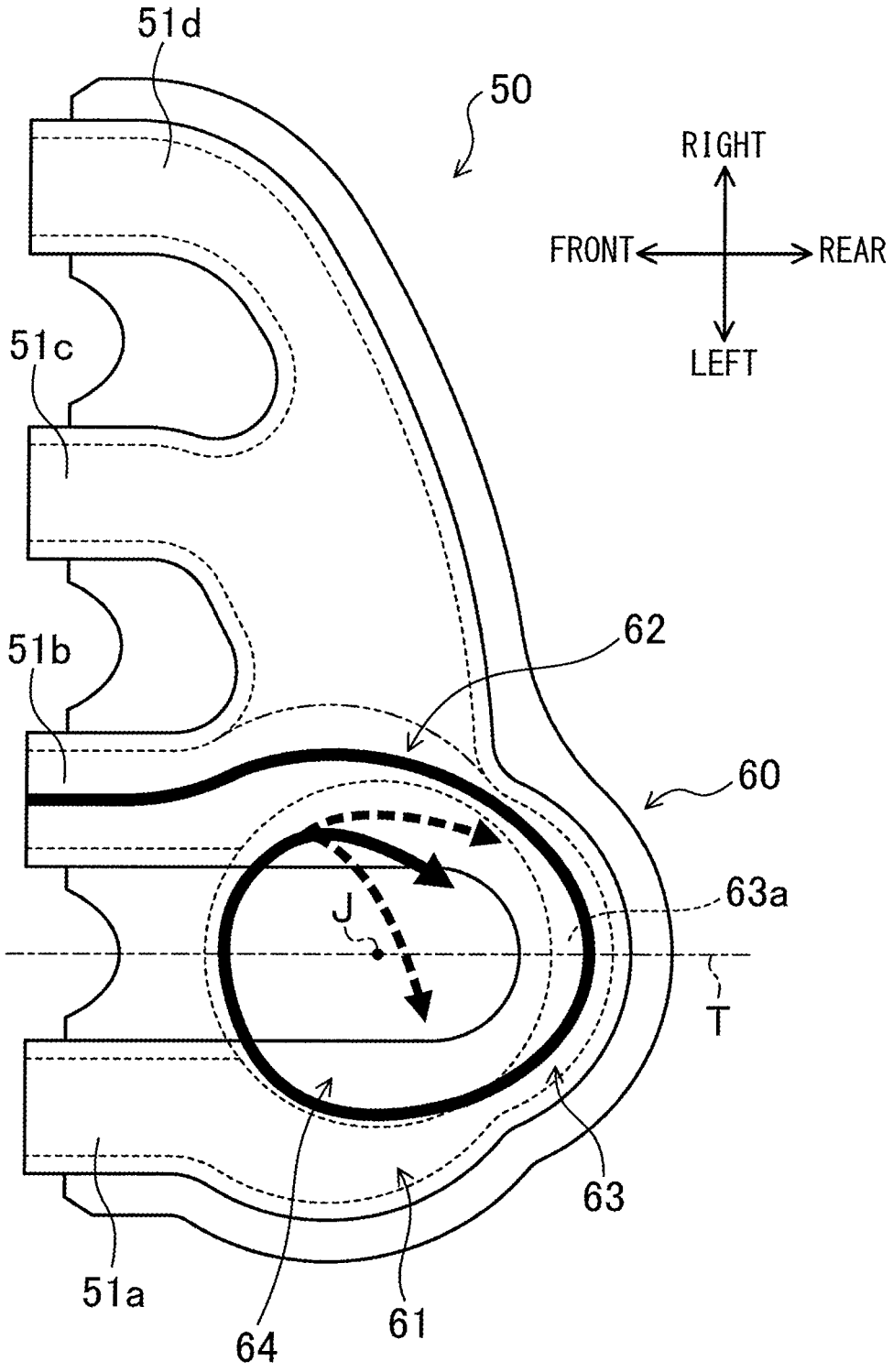
FIG. 11 is a schematic diagram of the internal space of the exhaust manifold when viewed from above, and a thick arrow denotes the flow of the exhaust gas of the second cylinder.

Each of thick arrows shown in FIGS. 7 to 9 schematically shows the flow of the exhaust gas of the first cylinder 2*a*. Each of solid lines shows a main flow, and each of broken lines shows a diffusion flow. Each of FIGS. 10 and 11 schematically shows the flow of the exhaust gas of the second cylinder 2*b*.

When viewed from above, the exhaust gas of the first cylinder 2*a* is rotated and guided counterclockwise, and the exhaust gas of the second cylinder 2*b* is rotated and guided clockwise. The exhaust gas, having flowed into the rotating portion 64, flows toward the catalyst converter 90 while being rotated.

By the rotation of the exhaust gas, a distance to the circular end surface 94*a* of the catalyst 94 increases. Therefore, a flow velocity of the exhaust gas decreases while the exhaust gas is being diffused. As a result, when the exhaust gas flows into the circular end surface 94*a*, the uniformization of the flow of the exhaust gas of the first cylinder 2*a* and the uniformization of the flow of the exhaust gas of the second cylinder 2*b* are accelerated. Thus, purification performance is improved.

At this time, both the main flow of the exhaust gas from the first guiding portion 61 toward the catalyst converter 90 and the main flow of the exhaust gas from the second guiding portion 62 toward the catalyst converter 90 are designed so as to be directed to a certain portion of the circular end surface 94*a*.

Specifically, as shown in FIGS. 9 and 11, when the collecting portion 60 is viewed from above, the first guiding portion 61, the second guiding portion 62, and the rotating/guiding portion 63 are arranged symmetrically with respect to a symmetrical line T which overlaps the vertical axis J and equally separates the first guiding portion 61 and the second guiding portion 62 from each other.

Figure 12:
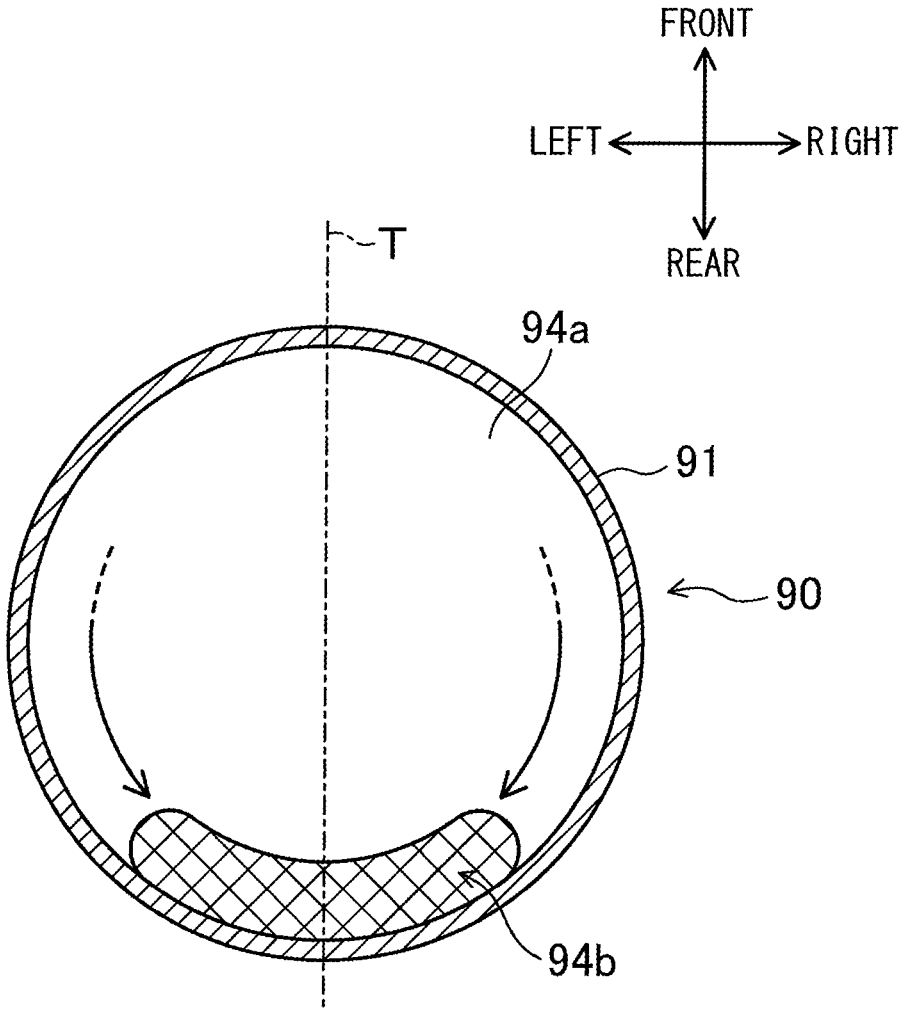
FIG. 12 is a schematic diagram for detailing a portion where the exhaust gas flows into a catalyst.

As shown in FIG. 12, the main flow of the exhaust gas of the first cylinder 2*a* and the main flow of the exhaust gas of the second cylinder 2*b* are designed so as to flow toward a portion of the circular end surface 94*a*, the portion being located in the vicinity of the symmetrical line T. In the present embodiment, the main flow of the exhaust gas of the first cylinder 2*a* and the main flow of the exhaust gas of the second cylinder 2*b* are designed so as to flow toward a portion (directed portion 94*b*) which is shown by mesh-like lines and is located at a side away from the engine 1 and in the vicinity of the symmetrical line T.

As a result, the flow of the exhaust gas of the first cylinder 2*a* and the flow of the exhaust gas of the second cylinder 2*b* flow in the exhaust manifold 50 in left-right symmetry such that, when viewed from a lateral side, the flow of the exhaust gas of the second cylinder 2*b* becomes the same as the flow of the exhaust gas of the first cylinder 2*a* of FIG. 8 except for the rotation direction.

Even if the exhaust gas is rotated, it is difficult to completely diffuse the flow of the exhaust gas. In reality, the main flow, where the exhaust gas strongly flows, remains to some extent. Therefore, if a portion of the circular end surface 94*a*, into which the main flow of the exhaust gas of the cylinder 2*a* flows, a portion of the circular end surface 94*a*, into which the main flow of the exhaust gas of the cylinder 2*b* flows, a portion of the circular end surface 94*a*, into which the main flow of the exhaust gas of the cylinder 2*c* flows, and a portion of the circular end surface 94*a*, into which the main flow of the exhaust gas of the cylinder 2*d* flows, are different from one another, a portion of the catalyst 94 which functions by the exhaust gas of the cylinder 2*a*, a portion of the catalyst 94 which functions by the exhaust gas of the cylinder 2*b*, a portion of the catalyst 94 which functions by the exhaust gas of the cylinder 2*c*, and a portion of the catalyst 94 which functions by the exhaust gas of the cylinder 2*d* become different from one another. Thus, purification performance may deteriorate.

However, according to the exhaust pipe structure 5*a*, the main flow of the exhaust gas of the first cylinder 2*a* and the main flow of the exhaust gas of the second cylinder 2*b* are designed so as to flow toward the directed portion 94*b*. Therefore, a decrease in purification performance can be prevented.

Third and Fourth Exhaust Passages

The third exhaust passage 51*c* and the fourth exhaust passage 51*d* are located further away from the collecting portion 60 than the first exhaust passage 51*a* and the second exhaust passage 51*b*. Therefore, if the exhaust passages 51*c* and 51*d* are connected to a periphery of the collecting portion 60 such that the exhaust gas of the exhaust passage 51*c* and the exhaust gas of the exhaust passage 51*d* flow toward a center of the collecting portion 60, the directivity of the exhaust gas of the exhaust passage 51*c* and the directivity of the exhaust gas of the exhaust passage 51*d* increase so that the exhaust gas flows into the collecting portion 60 at high velocity. As a result, in a state where the diffusion of the exhaust gas is inadequate, the exhaust gas flows into the catalyst 94, and the main flow of the exhaust gas of the exhaust passage 51*c* and the main flow of the exhaust gas of the exhaust passage 51*d* flow into different portions of the circular end surface 94*a*.

The exhaust pipe structure 5*a* is devised such that the exhaust gas discharged from the third cylinder 2*c* and the exhaust gas discharged from the fourth cylinder 2*d* can also be introduced to the catalyst converter 90 in a balanced manner.

Figure 13:
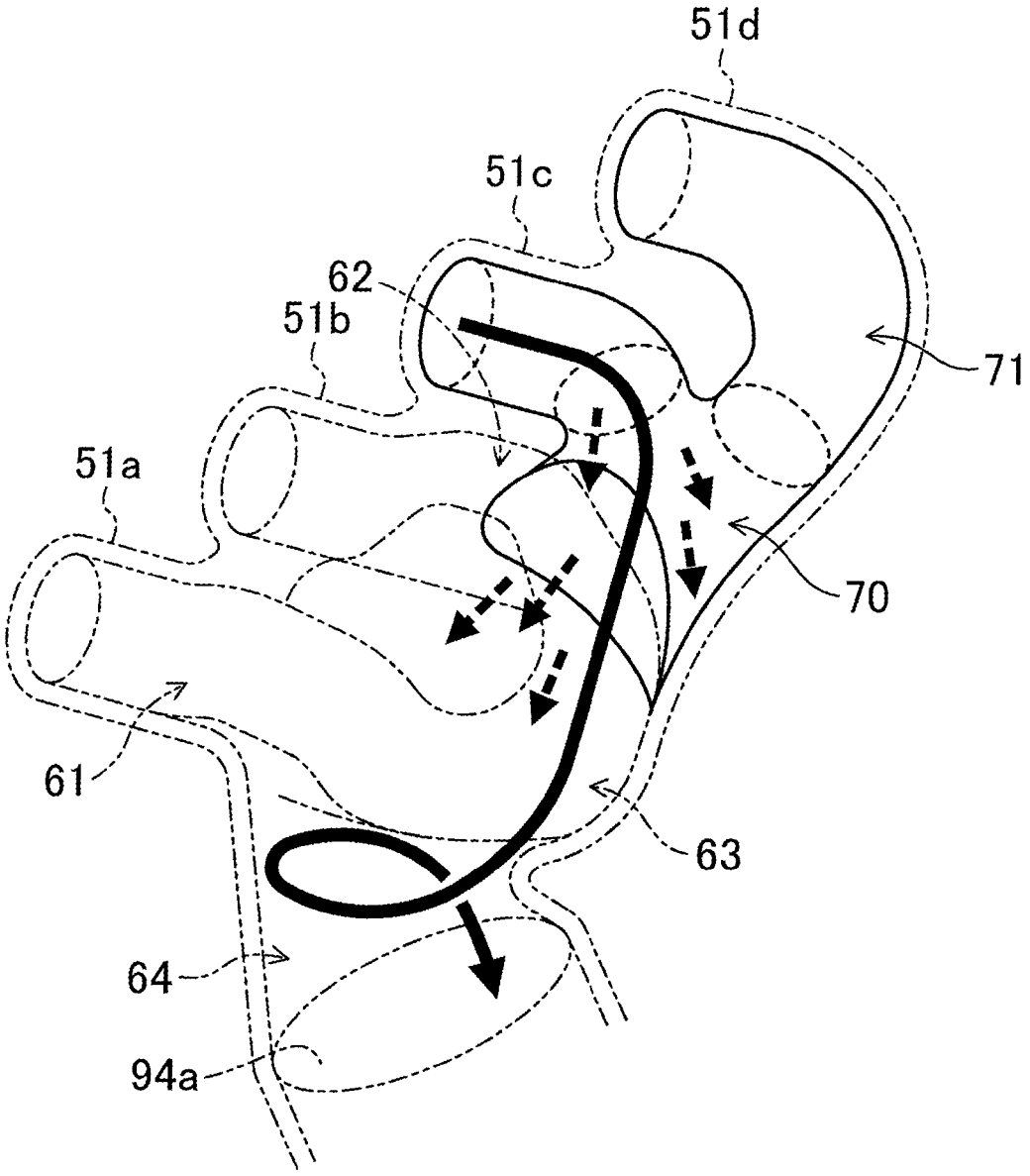
FIG. 13 is a schematic perspective view of the internal space of the exhaust manifold, and a thick arrow denotes the flow of the exhaust gas of a third cylinder.
Figure 14:
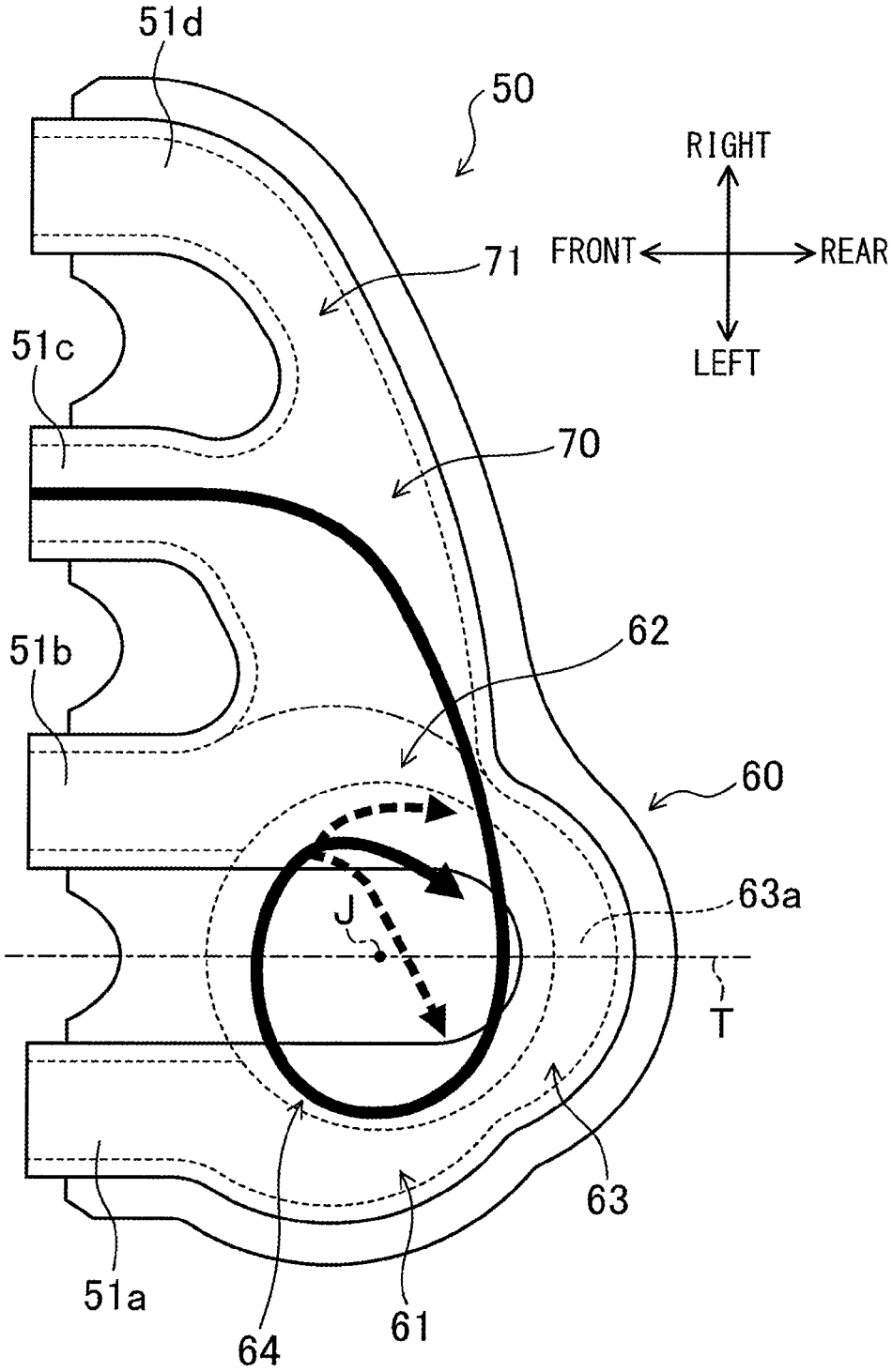
FIG. 14 is a schematic diagram of the internal space of the exhaust manifold when viewed from above, and a thick arrow denotes the flow of the exhaust gas of the third cylinder.

Specifically, as shown in FIGS. 13 and 14, an expanded space portion 70 is provided for the third exhaust passage 51*c* and the fourth exhaust passage 51*d*. The expanded space portion 70 expands a channel through which the exhaust gas flows. More specifically, the expanded space portion 70 is formed such that a downstream portion of the third exhaust passage 51*c* and a downstream portion of the fourth exhaust passage 51*d* are joined to and are integrated with each other.

Therefore, when the exhaust gas flowing through the third exhaust passage 51*c* and the exhaust gas flowing through the fourth exhaust passage 51*d* flow through the expanded space portion 70, the volume of the passage is doubled, so that the flow velocity of the exhaust gas decreases, and the diffusion of the exhaust gas is accelerated.

Figure 15:
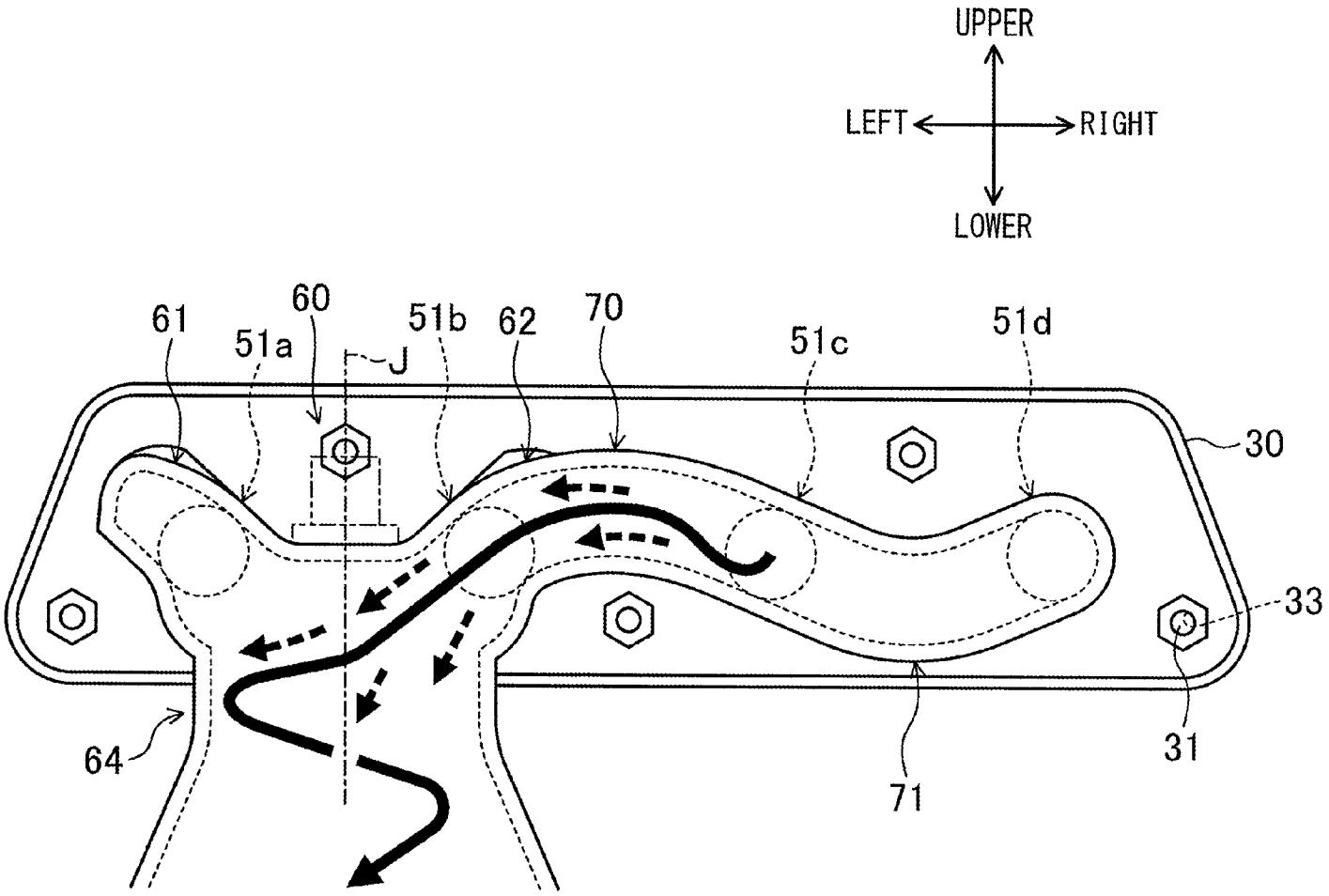
FIG. 15 is a schematic diagram of the internal space of the exhaust manifold when viewed from behind, and a thick arrow denotes the flow of the exhaust gas of the third cylinder.

As shown in FIG. 15, the downstream portion of the third exhaust passage 51*c* and the downstream portion of the fourth exhaust passage 51*d*, which constitute the expanded space portion 70, curve and extend between the second exhaust passage 51*b* and the third exhaust passage 51*c* in the cylinder row direction so as to be convex in the upward direction. Therefore, according to the exhaust pipe structure 5*a*, the downstream portion of the third exhaust passage 51*c* and the downstream portion of the fourth exhaust passage 51*d*, which constitute the expanded space portion 70, constitute respective upward curved portions.

Further, as shown in FIG. 14, the downstream portions constituting the expanded space portion 70 are integrated so as to approximate each other, curve, and extend toward the collecting portion 60 in a substantially horizontal direction. A downstream end portion of the expanded space portion 70 is connected to a right portion of the collecting portion 60, and the expanded space portion 70 communicates with the second guiding portion 62.

As shown in FIGS. 13 to 15, the main flow of the exhaust gas discharged from the third cylinder 2*c* and flowing through the third exhaust passage 51*c* into the expanded space portion 70 flows across the expanded space portion 70 and is then guided by a curved inner surface which is continuous with the fourth exhaust passage 51*d*. Thus, the exhaust gas flows toward the collecting portion 60 while largely rotating in a substantially horizontal plane. Further, the exhaust gas flows into the collecting portion 60 while being guided obliquely downward by the curved expanded space portion 70.

The main flow of the exhaust gas of the third cylinder 2*c*, which flows into the collecting portion 60 at low velocity, is directed to the rotating portion 64 and is rotated and guided by the inner surface of the rotating portion 64 toward the catalyst converter 90. As with the main flow of the exhaust gas of the first cylinder 2*a* and the main flow of the exhaust gas of the second cylinder 2*b*, the main flow of the exhaust gas of the third cylinder 2*c* is designed so as to be directed to the directed portion 94*b*.

An upstream portion of the expanded space portion 70 at the fourth exhaust passage 51*d* curves and extends downward (downward curved portion 71). Specifically, the fourth exhaust passage 51*d* includes the downward curved portion 71, which curves and extends between the fourth exhaust passage 51*d* and the third exhaust passage 51*c* in the cylinder row direction so as to be smoothly continuous with the expanded space portion 70 and be convex in the downward direction.

Figure 16:
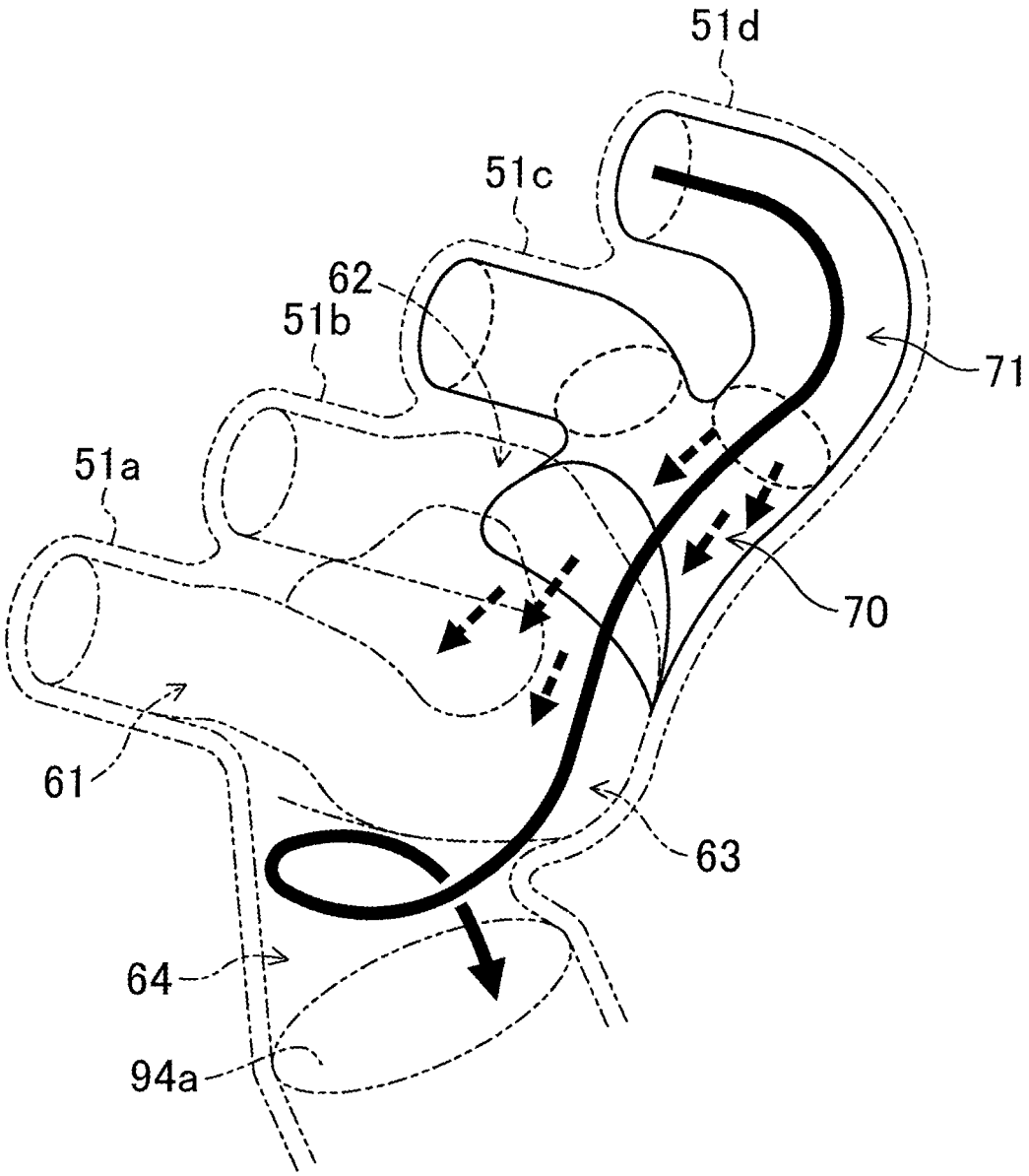
FIG. 16 is a schematic perspective view of the internal space of the exhaust manifold, and a thick arrow denotes the flow of the exhaust gas of a fourth cylinder.
Figure 17:
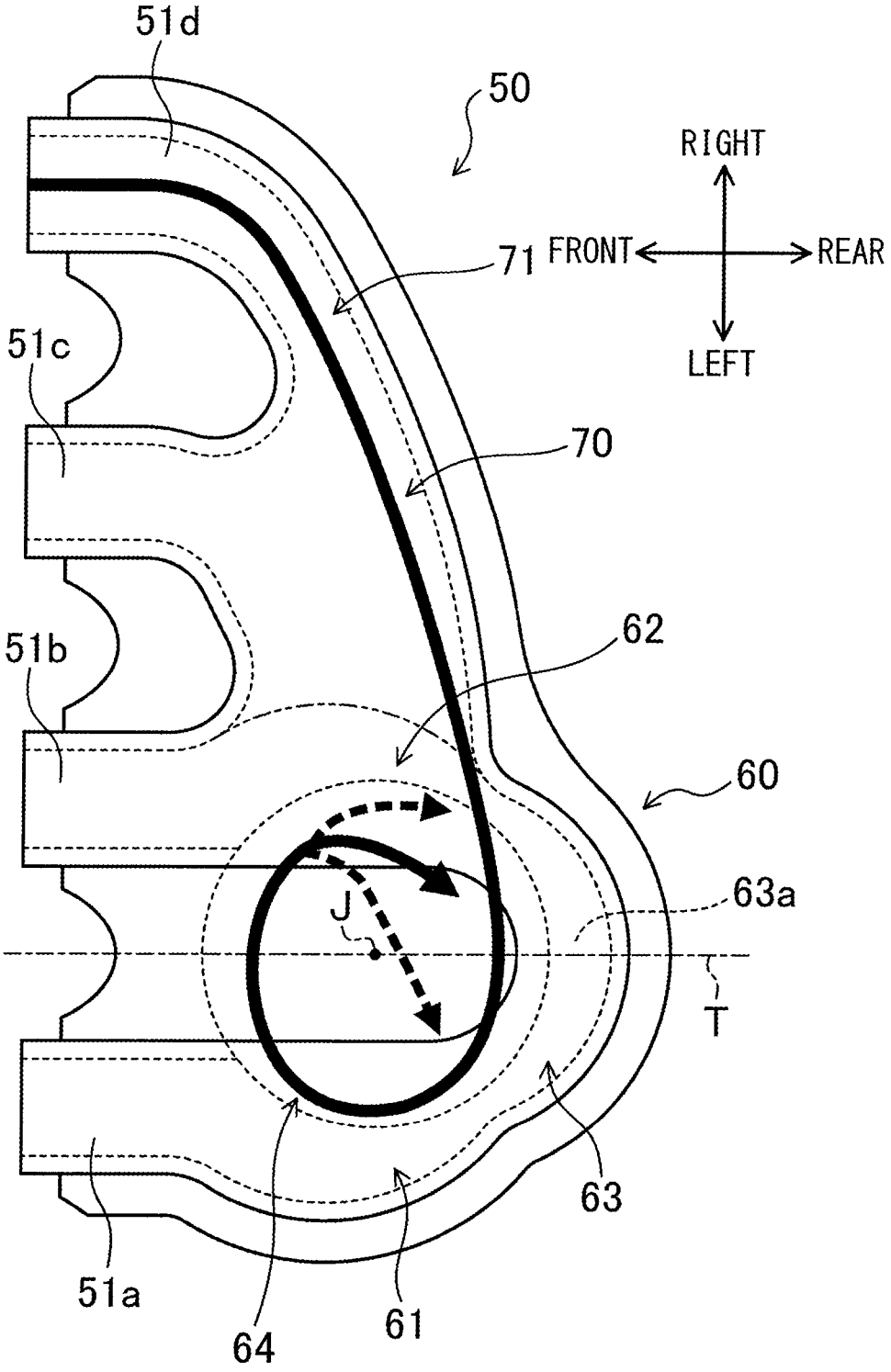
FIG. 17 is a schematic diagram of the internal space of the exhaust manifold when viewed from above, and a thick arrow denotes the flow of the exhaust gas of the fourth cylinder.
Figure 18:
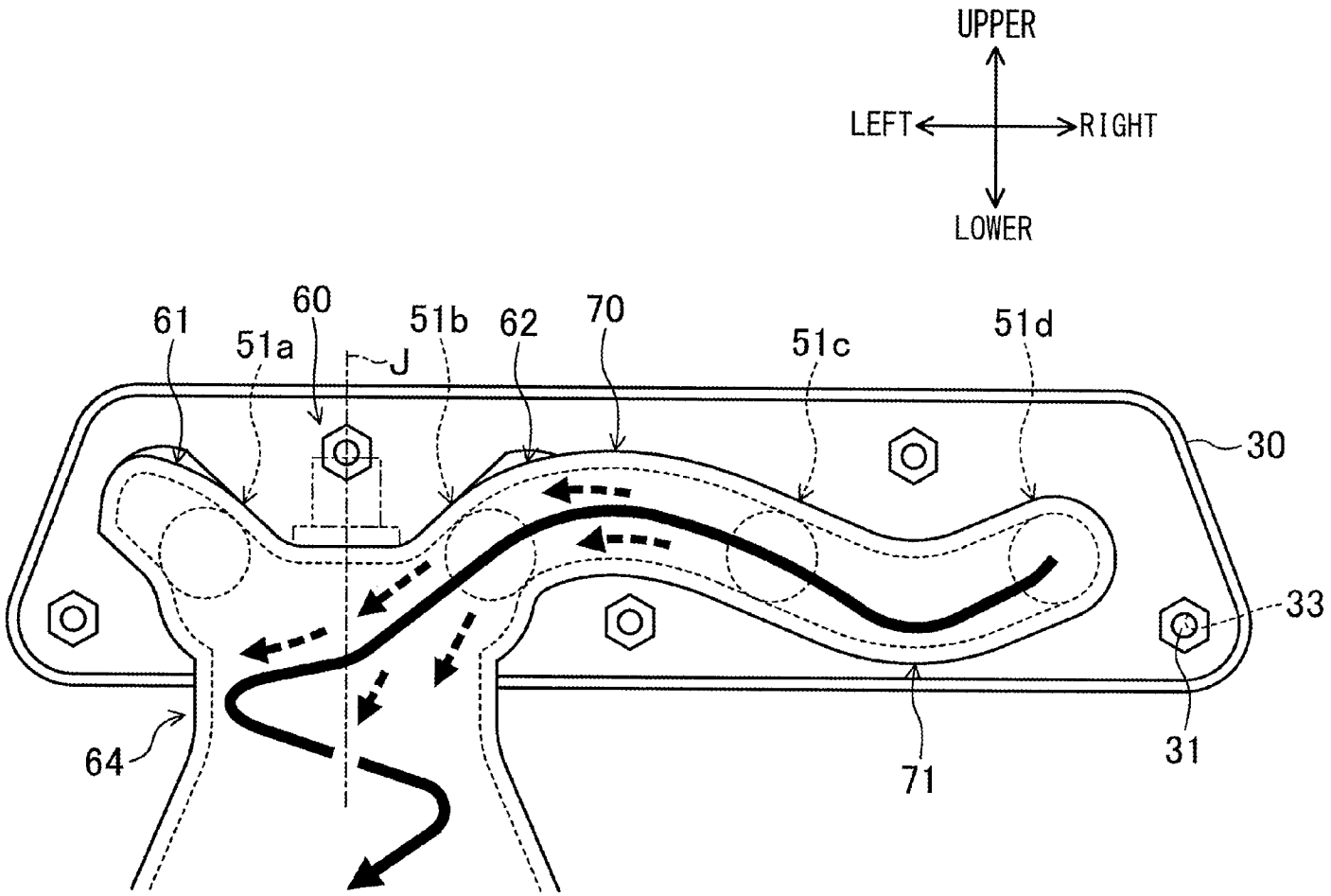
FIG. 18 is a schematic diagram of the internal space of the exhaust manifold when viewed from behind, and a thick arrow denotes the flow of the exhaust gas of the fourth cylinder.

As shown in FIGS. 16 to 18, the main flow of the exhaust gas discharged from the fourth cylinder 2*d* and flowing through the fourth exhaust passage 51*d* is guided by the fourth exhaust passage 51*d* and largely rotated toward the collecting portion 60 in a substantially horizontal plane. Further, the main flow of the exhaust gas is guided by the downward curved portion 71 and the expanded space portion 70 and flows toward the collecting portion 60 while meandering in a vertical direction. At last, the main stream of the exhaust gas is guided obliquely downward to flow into the collecting portion 60.

As with the main flow of the exhaust gas of the third cylinder 2*c*, the main flow of the exhaust gas of the fourth cylinder 2*d*, which flows into the collecting portion 60 at low velocity, is directed to the rotating portion 64 and is rotated and guided by the inner surface of the rotating portion 64 toward the catalyst converter 90. Therefore, as with the main flow of the exhaust gas of each of the first cylinder 2*a*, the second cylinder 2*b*, and the third cylinder 2*c*, the main flow of the exhaust gas of the fourth cylinder 2*d* is also directed to the directed portion 94*b*.

Therefore, according to the exhaust pipe structure 5*a*, most of the exhaust gas discharged from the first to fourth cylinders 2*a* to 2*d* flows into the directed portion 94*b* of the catalyst 94. On this account, the purification performance of the catalyst 94 can be effectively prevented from varying among the cylinders 2*a* to 2*d*. As a result, the catalytic function of the three way catalyst can be efficiently exhibited, so that the purification performance of the exhaust gas is improved.

The position of the directed portion 94*b* to which the main flow of the exhaust gas of the cylinders 2*a* to 2*d* is directed is not limited to the position shown in FIG. 12. For example, the position of the directed portion 94*b* may be set to be near a center of the circular end surface 94*a* of the catalyst converter 90.

Technique for Attachment

According to the exhaust pipe structure 5*a*, the attachment flange 30 is easily attached to the cylinder head 1*b* by utilizing the shape of the exhaust manifold 50.

To be specific, as shown in FIG. 6, a plurality of projecting external screws 31 (fastened portions) are provided on a side surface of the cylinder head 1*b*. For ensuring sealing performance, a sealing member 32 that is a thin film is arranged between the cylinder head 1*b* and the attachment flange 30.

The attachment flange 30 is provided with a plurality of fastening holes 33 (fastening portions) whose positions correspond to the positions of the external screws 31. Two fastening holes 33 are formed at an upper side of the exhaust manifold 50, and three fastening holes 33 are formed at a lower side of the exhaust manifold 50.

Specifically, the fastening holes 33 are formed close to the exhaust manifold 50. In the cylinder row direction (when viewed from behind; see FIG. 15), the fastening holes 33 are alternately arranged so as to be located at an obliquely lower side of the first exhaust passage 51*a*, between an upper portion of the first guiding portion 61 and an upper portion of the second guiding portion 62, above the downward curved portion 71, under the expanded space portion 70, and at an obliquely lower side of the fourth exhaust passage 51*d*.

The attachment flange 30 is fixed to the cylinder head 1*b* such that the external screws 31 are inserted into the corresponding fastening holes 33 and fastened with nuts. Since fastening portions are arranged in the vicinity of the first to fourth exhaust passages 51*a* to 51*d* in a balanced manner, the attachment flange 30 can be stably fixed to the cylinder head 1*b*, thereby improving sealing performance.

In addition, as is clear from FIG. 15, etc., even in a case where the fastening holes 33 are formed in the vicinity of the exhaust manifold 50, adequate spaces can be secured around the fastening holes 33 and on extended lines of the fastening holes 33 by the shape of the meandering exhaust manifold 50. Therefore, assembly of the attachment flange 30 can be easily performed.

Since the exhaust gas is high in temperature, the exhaust manifold 50 and the catalyst converter 90 become high in temperature during vehicle operation. Therefore, during vehicle operation, the exhaust manifold 50 and the catalyst converter 90 expand, and attaching portions tend to distort. Especially in the exhaust pipe structure 5*a*, the attachment flange 30 is attached to the cylinder head 1*b*, and the catalyst converter 90 is attached to the cylinder block 1*a*, so that the exhaust pipe structure 5*a* is easily influenced by the high temperature.

When the catalyst converter 90 expands, force is applied in such a direction that a lower side of the catalyst converter 90 is lifted up. As a result, force is applied to the attachment flange 30 in such a direction that a lower side of the attachment flange 30 is turned up. According to the exhaust pipe structure 5*a*, the number of fastening portions at the lower side of the attachment flange 30 is larger than the number of fastening portions at the upper side of the attachment flange 30, thereby preventing loosening of the fastening by heat expansion from occurring.

Others

The exhaust pipe structure according to the present invention is not limited to the above embodiment and includes various other components.

The engine may be arranged longitudinally such that the cylinders are lined up in a forward/rearward direction of the car. The engine is not limited to a four cylinder engine. For example, the engine may be a three cylinder engine or a six cylinder engine. The structure of the exhaust manifold and the structure of the catalyst converter are just examples and can be suitably modified within the scope of the technical concept.

REFERENCE CHARACTER LIST

1 engine
2*a* to 2*d* first to fourth cylinders
30 attachment flange
33 fastening hole (fastening portion)
50 exhaust manifold
51*a* to 51*d* first to fourth exhaust passages
53 exhaust gas sensor
54 upper wall member
55 lower wall member
60 collecting portion
61 first guiding portion
62 second guiding portion
63 rotating/guiding portion
64 rotating portion
65 depression
70 expanded space portion (upward curved portion)
71 downward curved portion
90 catalyst converter
94 catalyst

The invention claimed is:

1. An exhaust pipe structure with a catalyst converter provided immediately close to an engine including three or more cylinders, the exhaust pipe structure comprising:

a plurality of exhaust passages which communicate with the respective cylinders, are lined up along a cylinder row, and extend in a direction away from the engine;

a collecting portion to which downstream end portions of the exhaust passages are collectively connected; and the catalyst converter connected to a lower side of the collecting portion, wherein:

the plurality of exhaust passages include a first exhaust passage provided at an end side of the cylinder row, and a second exhaust passage adjacent to the first exhaust passage;

the collecting portion is arranged between the first exhaust passage and the second exhaust passage in a cylinder row direction;

the collecting portion includes a first guiding portion and a second guiding portion which are continuous with the first exhaust passage and the second exhaust passage, respectively, and extend so as to be spaced apart from each other and opposing each other, a downstream portion of the first guiding portion and a downstream portion of the second guiding portion being inclined obliquely downward, and a rotating/guiding portion which is continuous with a downstream side of the first guiding portion and a downstream side of the second guiding portion; and the collecting portion is configured such that exhaust gas introduced from the first exhaust passage and exhaust gas introduced from second exhaust passage are guided obliquely downward by the first guiding portion and the second guiding portion, respectively, and the exhaust gas introduced from the first exhaust passage and the exhaust gas introduced from second exhaust passage are then rotated and guided by the rotating/guiding portion in respective directions opposite to each other to flow toward the catalyst converter.

2. The exhaust pipe structure according to claim 1, wherein:

upper portions of the first and second guiding portions of the collecting portion bulge; and an exhaust gas sensor is arranged in a depression formed between the upper portions of the first and second guiding portions.

3. The exhaust pipe structure according to claim 2, further comprising an attachment flange which is attached to the engine and to which upstream end portions of the exhaust passages are connected, wherein:

the attachment flange includes a plurality of fastening portions fastened to the engine; and one of the fastening portions faces the depression formed between the upper portions of the first and second guiding portions.

4. The exhaust pipe structure according to claim 1, wherein the plurality of exhaust passages and the collecting portion are formed in such a manner that a pair of upper and lower wall members face each other and are joined to each other.

5. The exhaust pipe structure according to claim 2, wherein the plurality of exhaust passages and the collecting portion are formed in such a manner that a pair of upper and lower wall members face each other and are joined to each other.

6. The exhaust pipe structure according to claim 3, wherein the plurality of exhaust passages and the collecting portion are formed in such a manner that a pair of upper and lower wall members face each other and are joined to each other.

* * * * *